US010789894B2

(12) United States Patent
Zheng et al.

(10) Patent No.: US 10,789,894 B2
(45) Date of Patent: Sep. 29, 2020

(54) DRIVE METHOD FOR DISPLAY PANEL

(71) Applicant: Wuhan China Star Optoelectronics Technology Co., Ltd., Wuhan (CN)

(72) Inventors: Lihua Zheng, Wuhan (CN); Mang Zhao, Wuhan (CN); Yong Tian, Wuhan (CN)

(73) Assignee: Wuhan China Star Optoelectronics Technology Co., Ltd., Wuhan (CN)

( * ) Notice: Subject to any disclaimer, the term of this patent is extended or adjusted under 35 U.S.C. 154(b) by 48 days.

(21) Appl. No.: 16/332,357

(22) PCT Filed: Dec. 21, 2018

(86) PCT No.: PCT/CN2018/122901
§ 371 (c)(1),
(2) Date: Mar. 12, 2019

(87) PCT Pub. No.: WO2020/107585
PCT Pub. Date: Jun. 4, 2020

(65) Prior Publication Data

US 2020/0168158 A1 May 28, 2020

(30) Foreign Application Priority Data

Nov. 28, 2018 (CN) ..... 2018 1 1436782

(51) Int. Cl.
*G09G 3/3266* (2016.01)
*G09G 3/36* (2006.01)

(52) U.S. Cl.
CPC ..... *G09G 3/3266* (2013.01); *G09G 3/3677* (2013.01); *G09G 2310/0297* (2013.01)

(58) Field of Classification Search
USPC ..... 345/204
See application file for complete search history.

(56) References Cited

U.S. PATENT DOCUMENTS

2004/0125065 A1* 7/2004 Park ..... G09G 3/20 345/92
2006/0232541 A1* 10/2006 Kudo ..... G09G 3/3688 345/98
2007/0171165 A1* 7/2007 Chuang ..... G09G 3/3688 345/88
2008/0309599 A1* 12/2008 Tsuda ..... G09G 3/3688 345/88
2009/0231363 A1* 9/2009 Liu ..... G09G 3/3688 345/690
2015/0061983 A1* 3/2015 Kim ..... G09G 3/3275 345/82

(Continued)

*Primary Examiner* — Chineyere D Wills-Burns

(57) ABSTRACT

A drive method for a display panel is provided. A first multiplex signal, a second multiplex signal, a third multiplex signal, a fourth multiplex signal, a fifth multiplex signal, and a sixth multiplex signal sequentially generate the high level pulse in the predetermined order in each of the first row periods of the (2i−1)th multiplex period. In addition, the first multiplex signal, the second multiplex signal, the third multiplex signal, the fourth multiplex signal, the fifth multiplex signal, and the sixth multiplex signal sequentially generate the high level pulse in a reverse order to the predetermined order in each of the second row periods of the (2i)th multiplex period. As a result, mura within the display picture of the display panel is eliminated to improve the display quality.

10 Claims, 9 Drawing Sheets

(56) References Cited

U.S. PATENT DOCUMENTS

| | | | | |
|---|---|---|---|---|
| 2015/0287378 | A1* | 10/2015 | Jeong | G09G 3/2085<br>345/694 |
| 2016/0071459 | A1* | 3/2016 | Fujii | G09G 3/2003<br>345/690 |
| 2016/0093260 | A1* | 3/2016 | Watsuda | G09G 3/3688<br>345/87 |
| 2017/0076665 | A1* | 3/2017 | Kim | G09G 3/3275 |
| 2017/0221436 | A1* | 8/2017 | Guo | G09G 3/3607 |
| 2017/0262119 | A1* | 9/2017 | Guo | G09G 3/20 |
| 2019/0088185 | A1* | 3/2019 | Zhang | H01L 27/1214 |
| 2019/0096344 | A1* | 3/2019 | Zuo | G09G 3/3648 |
| 2019/0228730 | A1* | 7/2019 | Cong | G09G 3/3688 |

* cited by examiner

DRIVE METHOD FOR DISPLAY PANEL

RELATED APPLICATIONS

This application is a National Phase of PCT Patent Application No. PCT/CN2018/122901 having International filing date of Dec. 21, 2018, which claims the benefit of priority of Chinese Patent Application No. 201811436782.8 filed on Nov. 28, 2018. The contents of the above applications are all incorporated by reference as if fully set forth herein in their entirety.

FIELD AND BACKGROUND OF THE INVENTION

The present disclosure relates to the field of display technology, more particularly, to a drive method for a display panel.

With the development of display technology, flat display devices, such as liquid crystal display (LCD), have gradually replaced cathode ray tube (CRT) displays due to their advantages of high image quality, power saving, slim body and wide application range. They are extensively used in various consumer electronic products, including mobile phones, televisions, personal digital assistants, digital cameras, notebook computers, desktop computers, and the like, and have become the mainstream in display devices.

Currently, most of the liquid crystal display devices on the market are backlit liquid crystal display devices, each of which includes a liquid crystal display panel and a backlight module. The working principle of the liquid crystal display panel is to fill liquid crystal molecules between a thin film transistor array substrate (TFT array substrate) and a color filter substrate (CF substrate), and apply a driving voltage to the two substrates so as to control the rotation direction of the liquid crystal molecules. The light from the backlight module is refracted to generate a picture.

In the driver architecture of a liquid crystal display device in the related art, one pixel electrode has a data line and a gate line. This method can well control the turning on of the gate on each scan line and the input of data on each data line. However, as the resolution of the liquid crystal display panel increases, the numbers of data lines and scan lines also increase, which leads to an increase of the area occupied by the fanout wires of the data lines. As a result, the transmittance and display effect are affected. To solve this problem, the multiplexed driver architecture has been widely used, for example, the 1 to 6 De-mux driver architecture. The so-called 1 to 6 De-mux driver architecture refers to the use of one data signal to charge pixels of six columns by using the principle of time division multiplexing. A description is provided with reference to FIG. 1. A display panel of a 1 to 6 De-mux driver architecture in the related art comprises a plurality of driving units, each of which comprises a plurality of sub-pixels 100 arranged in a plurality of rows and 4 columns, 12 data lines 200, a plurality of scan lines 300, and a multiplexing module 400. Each of the pixels 100 comprises three sub-pixels 110 arranged in one row. The three sub-pixels 110 are sequentially a red sub-pixel r, a green sub-pixel g, and a blue sub-pixel b. The sub-pixels 110 of the plurality of pixels 100 are arranged in a plurality of rows and 12 columns, and the sub-pixels 110 of a same column have a same color. One data line 200 corresponds to one column of sub-pixels 110, one scan line 300 is connected to one row of sub-pixels 110 correspondingly. The multiplexing module 400 comprises 12 thin film transistors T10 respectively corresponding to the 12 columns of sub-pixels 110. Drains of the 12 thin film transistors T10 are respectively connected to the 12 data lines 200 connected to the 12 columns of sub-pixels 110. Sources of the thin film transistors T10 corresponding to the sub-pixels 100 of odd columns are all connected to an Nth data signal DN, here N is a positive integer. Sources of the thin film transistors T10 corresponding to the sub-pixels 100 of even columns are all connected to an (n+1)th data signal DN+1. Gates of the thin film transistors T10 corresponding to the red sub-pixels r in the pixels 100 of a first column and a second column are connected to a first multiplex signal MUX10. Gates of the thin film transistors T10 corresponding to the green sub-pixels g in the pixels 100 of the first column and the second column are connected to a second multiplex signal MUX20. Gates of the thin film transistors T10 corresponding to the blue sub-pixels b in the pixels 100 of the first column and the second column are connected to a third multiplex signal MUX30. Gates of the thin film transistors T10 corresponding to the red sub-pixels r in the pixels 100 of a third and a fourth column are connected to a fourth multiplex signal MUX40. Gates of the thin film transistors T10 corresponding to the green sub-pixels g in the pixels 100 of the third column and the fourth column are connected to a firth multiplex signal MUX50. Gates of the thin film transistors T10 corresponding to the blue sub-pixels b in the pixels 100 of the third column and the fourth column are connected to a sixth multiplex signal MUX60.

When the display panel is driven, a plurality of frame periods are sequentially performed. Each of the frame periods comprises a plurality of row periods that are sequentially performed, and the plurality of scan lines 300 are sequentially at a high level in the plurality of row periods. A description is provided with reference to FIG. 2. In each of the row periods, the first multiplex signal MUX10, the second multiplex signal MUX20, the third multiplex signal MUX30, the fourth multiplex signal MUX40, the fifth multiplex signal MUX50 and the sixth multiplex signal MUX60 sequentially generate a high level pulse to turn on the corresponding thin film transistor T10 so as to transmit a data signal to the corresponding sub-pixel 100. This drive method can reduce the area occupied by the fanout wires of the data lines to achieve a narrow bezel. However, the charging order of the plurality of sub-pixels 110 in each or the row periods is as follows: the red sub-pixels r in the pixels 100 of the first column and the second column, the green sub-pixels g in the pixels 100 of the first column and the second column, the blue sub-pixels b in the pixels 100 of the first column and the second column, the red sub-pixels r in the pixels 100 of the third column and the fourth column, the green sub-pixels g in the pixels 100 of the third column and the fourth column, and the blue sub-pixels b in the pixels 100 of the third column and the fourth column. When the pixels are insufficiently charged and the common voltage fluctuates, the display effect of the sub-pixel 110 that is charged first is better than the display effect of the sub-pixel 110 that is charged later. As a result, the display effect of the red sub-pixels r in the pixels 100 of the first column and the second column is better than the display effect of the red sub-pixels r in the pixels 100 of the third column and the fourth column. The display effect of the green sub-pixels g in the pixels 100 of the first column and the second column is better than the display effect of the green sub-pixels g in the pixels 100 of the third column and the fourth column. The display effect of the blue sub-pixels b in the pixels 100 of the first column and the second column is better than the display effect of the blue sub-pixels b in the pixels 100 of the third column and the fourth column. Therefore, as shown in FIG. 3, a difference in brightness occurs between the pixels 100 of the first column and the second column and the pixels of the third column and the fourth column, and finally results in mura within the picture of the display panel. The display effect is thus affected.

SUMMARY

One objective of the present disclosure is to provide a drive method for a display panel that can eliminate mura within the display picture of the display panel to improve the display quality.

The present disclosure provides a drive method for a display panel. The drive method for the display panel comprises the following steps:

step S1: providing a display panel;

the display panel comprising a plurality of driving units, each of the driving units comprising a plurality of pixels arranged in a plurality of rows and 4 columns, 12 data lines and a multiplexing module, each of the pixels comprising three sub-pixels arranged in one row, the three sub-pixels being sequentially a red sub-pixel, a green sub-pixel, and a blue sub-pixel, the sub-pixels of the plurality of pixels being arranged in a plurality of rows and 12 columns, the sub-pixels of a same column having a same color, one data line being connected to one column of sub-pixels correspondingly, the multiplexing module comprising 12 switching elements respectively corresponding to the 12 columns of sub-pixels, output terminals of the 12 switching elements being respectively connected to the 12 data lines connected to the 12 columns of sub-pixels, input terminals of the switching elements corresponding to the sub-pixels of odd columns being all connected to an nth data signal, wherein n is a positive integer, input terminals of the switching elements corresponding to the sub-pixels of even columns being all connected to an (n+1)th data signal, control terminals of the switching elements corresponding to the red sub-pixels in the pixels of a first column and a second column being connected to a first multiplex signal, control terminals of the switching elements corresponding to the green sub-pixels in the pixels of the first column and the second column being connected to a second multiplex signal, control terminals of the switching elements corresponding to the blue sub-pixels in the pixels of the first column and the second column being connected to a third multiplex signal, control terminals of the switching elements corresponding to the red sub-pixels in the pixels of a third column and a fourth column being connected to a fourth multiplex signal, control terminals of the switching elements corresponding to the green sub-pixels in the pixels of the third column and the fourth column being connected to a fifth multiplex signal, control terminals of the switching elements corresponding to the blue sub-pixels in the pixels of the third column and the fourth column being connected to a sixth multiplex signal;

step S2: entering a (2i−1)th multiplex period;

the (2i−1)th multiplex period comprising p first row periods, the first multiplex signal, the second multiplex signal, the third multiplex signal, the fourth multiplex signal, the fifth multiplex signal, and the sixth multiplex signal sequentially generating a high level pulse in each of the first row periods in a predetermined order, wherein i and p are both positive integers;

step S3: entering a (2i)th multiplex period;

the (2i)th multiplex period comprising p second row periods, the first multiplex signal, the second multiplex signal, the third multiplex signal, the fourth multiplex signal, the fifth multiplex signal, and the sixth multiplex signal sequentially generating the high level pulse in a reverse order to the predetermined order in each of the second row periods.

According to one embodiment of the present disclosure, each of the driving units further comprises a plurality of scan lines, one scan line is connected to one row of sub-pixels correspondingly.

According to one embodiment of the present disclosure, the (2i−1)th multiplex period comprises one first row period, the (2i)th multiplex period comprises one second row period.

According to one embodiment of the present disclosure, a voltage on a qth scan line is at a high level, and voltages on the scan lines other than the qth scan line in the plurality of scan lines are all at a low level in the (2i−1)th multiplex period, wherein q is a positive integer;

a voltage on a (q+1)th scan line is at the high level, and voltages on the scan lines other than the (q+1)th scan line in the plurality of scan lines are all at the low level in the (2i)th multiplex period.

According to one embodiment of the present disclosure, the (2i−1)th multiplex period comprises two first row periods that are sequentially performed, the (2i)th multiplex period comprises two second row periods that are sequentially performed.

According to one embodiment of the present disclosure, in a first one of the two first row periods of the (2i−1)th multiplex period, a voltage on a qth scan line is at a high level, and voltages on the scan lines other than the qth scan line in the plurality of scan lines are all at a low level, wherein q is a positive integer, in a second one of the two first row periods of the (2i−1)th multiplex period, a voltage on a (q+1)th scan line is at the high level, and voltages on the scan lines other than the (q+1)th scan line in the plurality of scan lines are all at the low level;

in a first one of the two second row periods of the (2i)th multiplex period, a voltage on a (q+2)th scan line is at a high level, and voltages on the scan lines other than the (q+2)th scan line in the plurality of scan lines are all at a low level, in a second one of the two second row periods of the (2i)th multiplex period, a voltage on a (q+3)th scan line is at the high level, and voltages on the scan lines other than the (q+3)th scan line in the plurality of scan lines are all at the low level.

According to one embodiment of the present disclosure, the first multiplex signal, the second multiplex signal, the third multiplex signal, the fourth multiplex signal, the fifth multiplex signal, and the sixth multiplex signal sequentially generate a high level pulse every first row period; the sixth multiplex signal, the fifth multiplex signal, the fourth multiplex signal, the third multiplex signal, the second multiplex signal, and the first multiplex signal sequentially generate a high level pulse every second row period.

According to one embodiment of the present disclosure, the display panel is a liquid crystal display (LCD) panel or an organic light emitting diode (OLED) panel.

According to one embodiment of the present disclosure, a duration of the high-level pulse of the first multiplex signal, the second multiplex signal, the third multiplex signal, the fourth multiplex signal, the fifth multiplex signal, and the sixth multiplex signal is the same.

According to one embodiment of the present disclosure, the switching elements are thin film transistors; the control terminals of the switching elements are gates of the thin film transistors, the input terminals of the switching elements are sources of the thin film transistors, and the output terminals of the switching elements are drains of the thin film transistors.

The beneficial effects of the present disclosure are as follows. According to the drive method for the display panel of the present disclosure, the first multiplex signal, the second multiplex signal, the third multiplex signal, the fourth multiplex signal, the fifth multiplex signal, and the sixth multiplex signal sequentially generate the high level pulse in the predetermined order in each of the first row periods of the (2i−1)th multiplex period. In addition, the first multiplex signal, the second multiplex signal, the third multiplex signal, the fourth multiplex signal, the fifth multiplex signal, and the sixth multiplex signal sequentially generate the high level pulse in a reverse order to the predetermined order in each of the second row periods of the (2i)th multiplex period. As a result, mura within the display picture of the display panel is eliminated to improve the display quality.

BRIEF DESCRIPTION OF THE SEVERAL VIEWS OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE SPECIFIC EMBODIMENTS OF THE INVENTION

For the purpose of description rather than limitation, the following provides such specific details as a specific system structure, interface, and technology for a thorough understanding of the application. However, it is understandable by persons skilled in the art that the application can also be implemented in other embodiments not providing such specific details.

Figure 1:
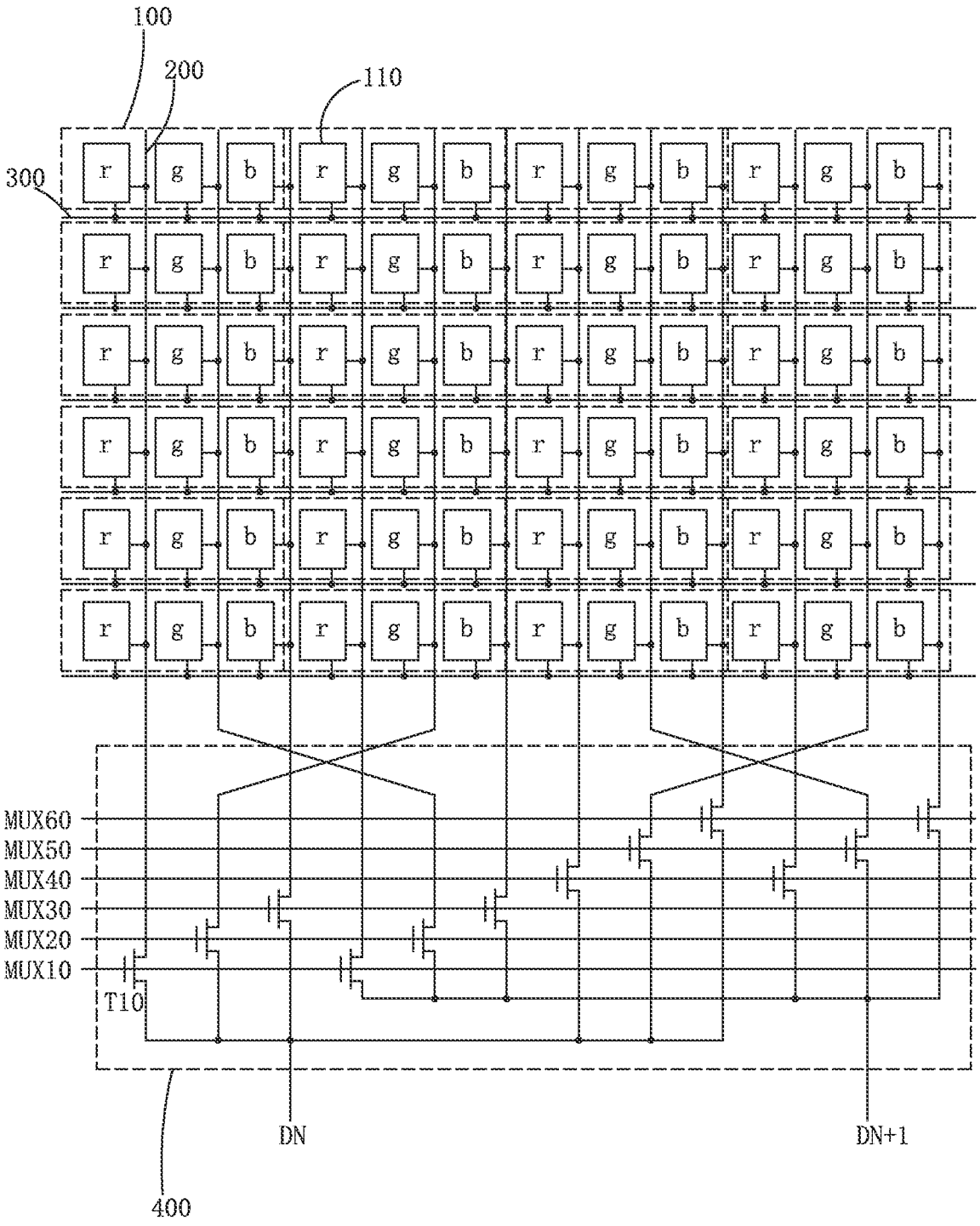
Fig. 1 (Related art)
FIG. 1 is a structural schematic diagram of a display panel of a 1 to 6 De-mux driver architecture in the related art.
Figure 2:
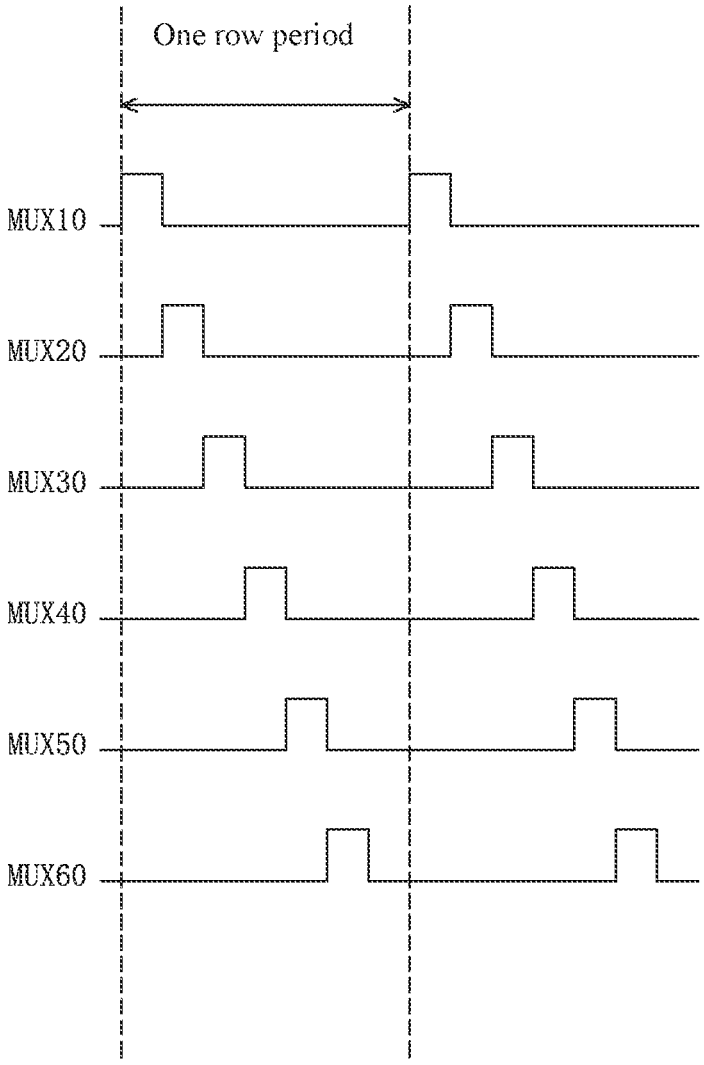
Fig. 2 (Related art)
FIG. 2 is a drive timing diagram of the display panel shown in FIG. 1.
Figure 3:
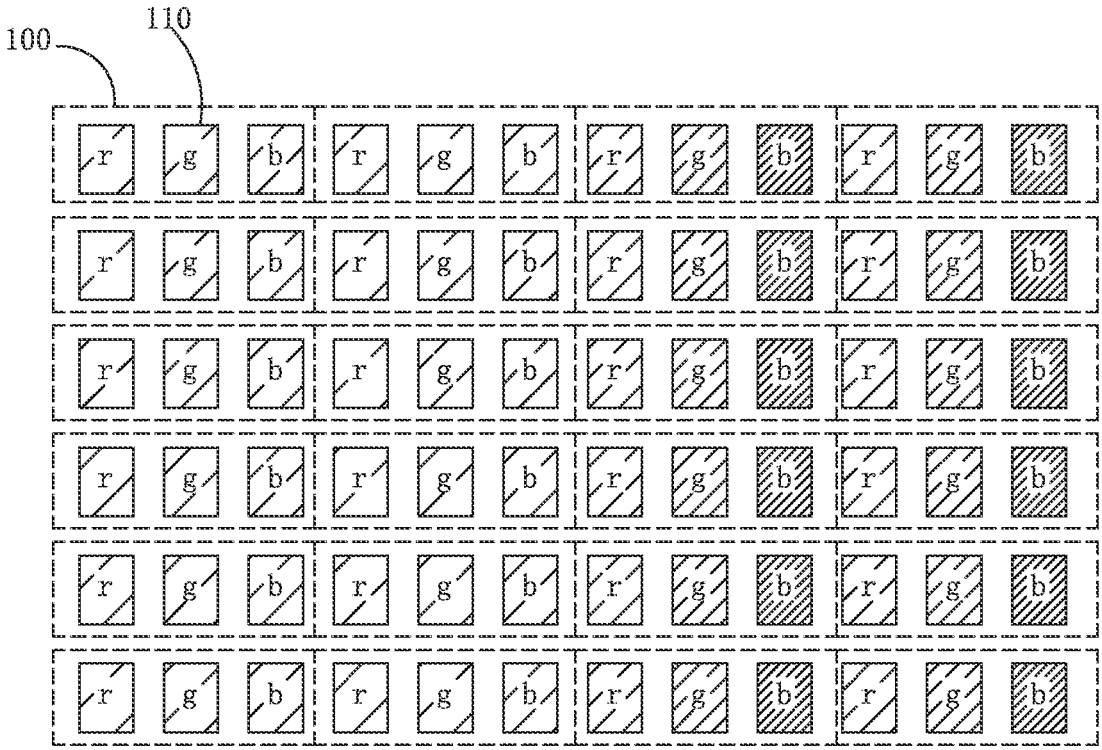
Fig. 3 (Related art)
FIG. 3 is a schematic diagram of a display effect of the display panel shown in FIG. 1.
Figure 4:
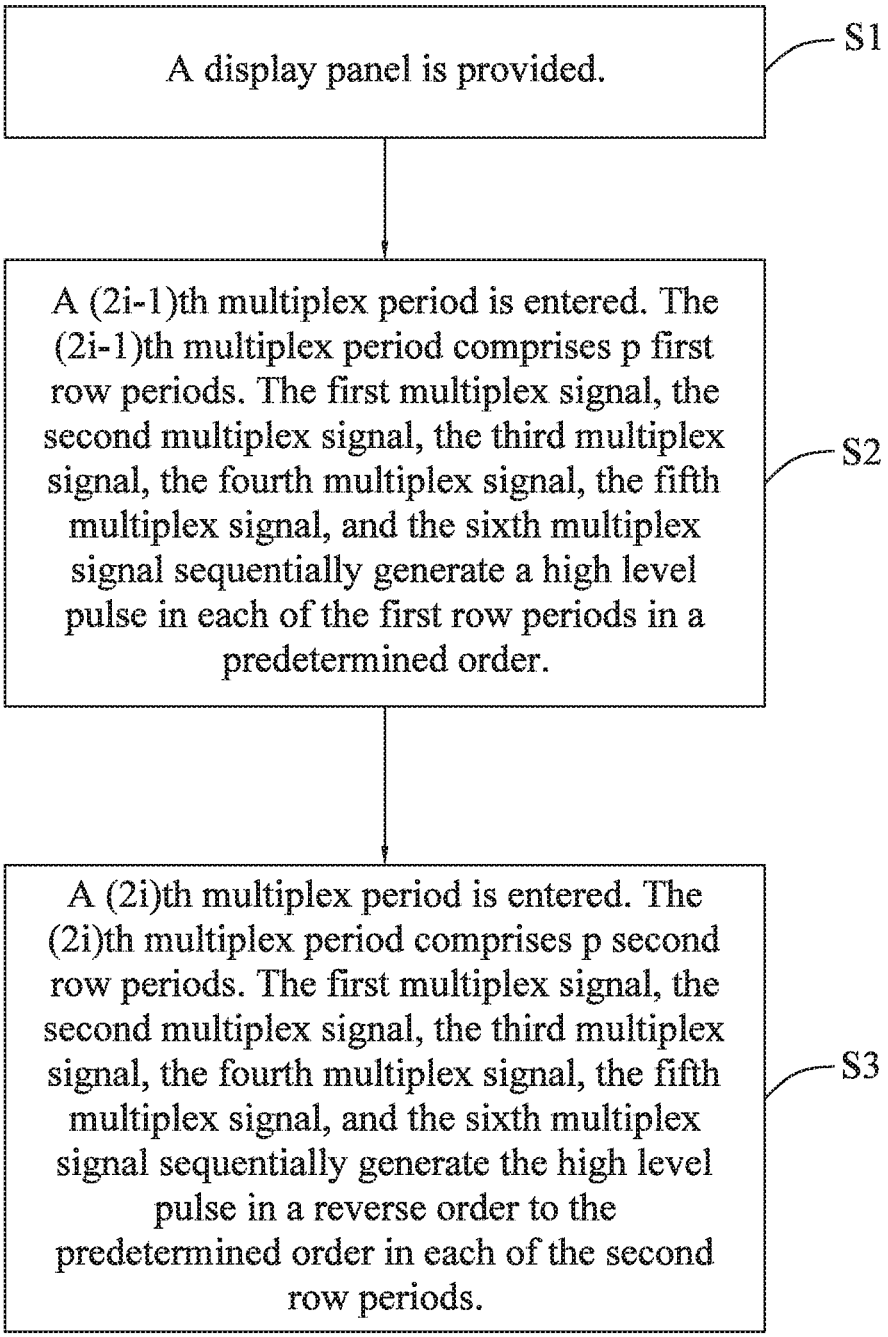
FIG. 4 is a flowchart of a drive method of a display panel according to the present disclosure.
Figure 5:
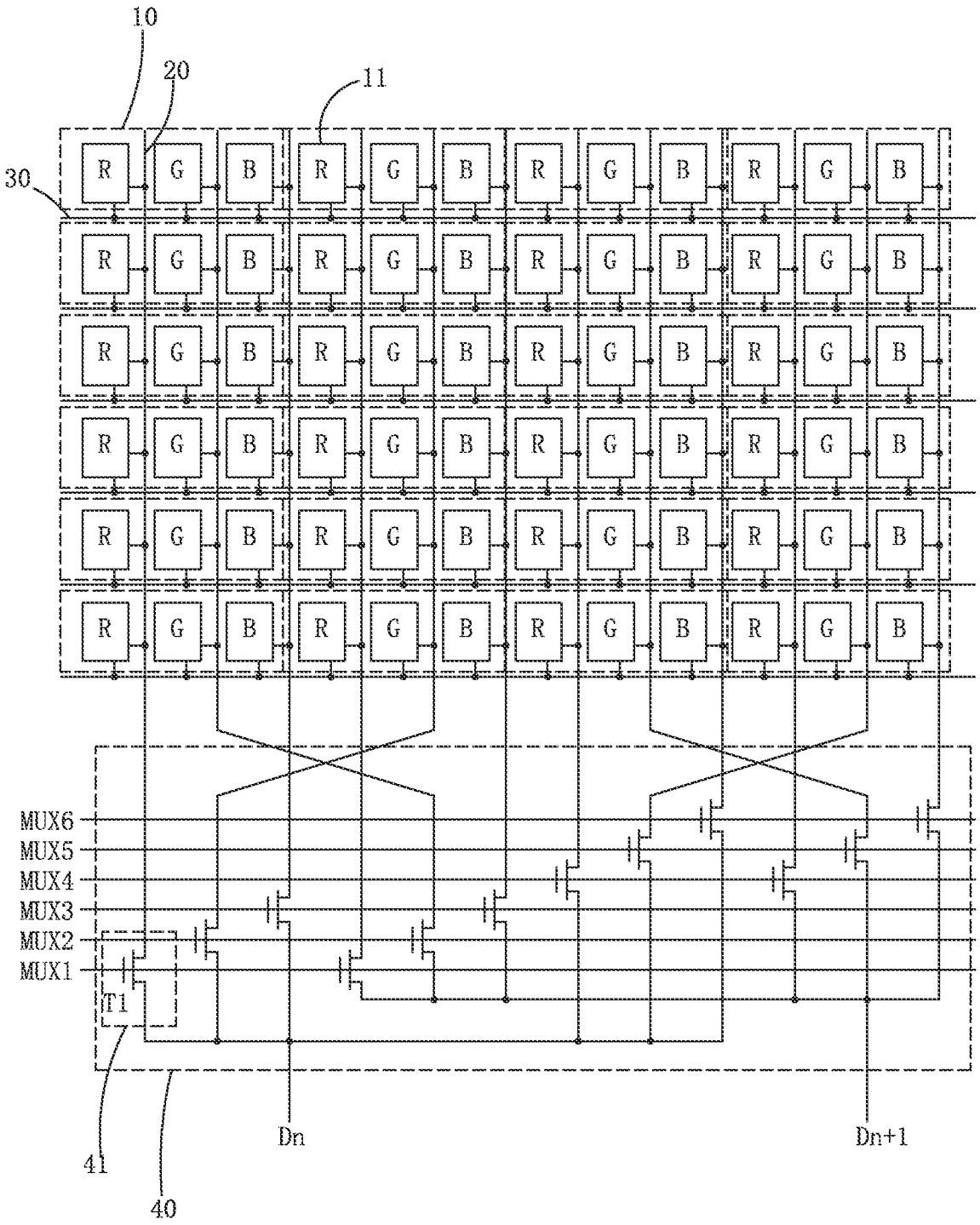
FIG. 5 is a schematic diagram of step S1 of a drive method of a display panel according to the present disclosure.

A description is provided with reference to FIG. 4. The present disclosure provides a drive method for a display panel that comprises the following steps:

Step S1: a display panel is provided with reference to FIG. 5.

The display panel comprises a plurality of driving units. Each of the driving units comprises a plurality of pixels 10 arranged in a plurality of rows and 4 columns, 12 data lines 20, a plurality of scan lines 30 and a multiplexing module 40. Each of the pixels 10 comprises three sub-pixels 11 arranged in one row. The three sub-pixels 11 are sequentially a red sub-pixel R, a green sub-pixel G, and a blue sub-pixel B. The sub-pixels 11 of the plurality of pixels 10 are arranged in a plurality of rows and 12 columns, and the sub-pixels 11 of a same column have a same color. One data line 20 is connected to one column of sub-pixels 11 correspondingly, one scan line 30 is connected to one row of sub-pixels 11 correspondingly. The multiplexing module 40 comprises 12 switching elements 41 respectively corresponding to the 12 columns of sub-pixels 11. Output terminals of the 12 switching elements 41 are respectively connected to the 12 data lines 200 connected to the 12 columns of sub-pixels 110. Input terminals of the switching elements 41 corresponding to the sub-pixels 11 of odd columns are all connected to an nth data signal Dn, here n is a positive integer. Input terminals of the switching elements 41 corresponding to the sub-pixels 11 of even columns are all connected to an (n+1)th data signal Dn+1. Control terminals of the switching elements 41 corresponding to the red sub-pixels R in the pixels 10 of a first column and a second column are connected to a first multiplex signal MUX1. Control terminals of the switching elements 41 corresponding to the green sub-pixels G in the pixels 10 of the first column and the second column are connected to a second multiplex signal MUX2. Control terminals of the switching elements 41 corresponding to the blue sub-pixels B in the pixels 10 of the first column and the second column are connected to a third multiplex signal MUX3. Control terminals of the switching elements 41 corresponding to the red sub-pixels R in the pixels 10 of a third column and a fourth column are connected to a fourth multiplex signal MUX4. Control terminals of the switching elements 41 corresponding to the green sub-pixels G in the pixels 10 of the third column and the fourth column are connected to a fifth multiplex signal MUX5. Control terminals of the switching elements 41 corresponding to the blue sub-pixels B in the pixels 10 of the third column and the fourth column are connected to a sixth multiplex signal MUX6.

The display panel may be a liquid crystal display panel or an organic light emitting diode (OLED) display panel.

The switching element 41 is a thin film transistor T1. The control terminal of the switching element 41 is a gate of the thin film transistor T1, an input terminal of the switching element 41 is a source of the thin film transistor T1, and an output terminal of the switching element 41 is a drain of the thin film transistor T1.

Step S2: A (2i−1)th multiplex period is entered.

The (2i−1)th multiplex period comprises p first row periods. The first multiplex signal MUX1, the second multiplex signal MUX2, the third multiplex signal MUX3, the fourth multiplex signal MUX4, the fifth multiplex signal MUX5, and the sixth multiplex signal MUX6 sequentially generate a high level pulse in each of the first row periods in a predetermined order. i and p are both positive integers.

Figure 6:
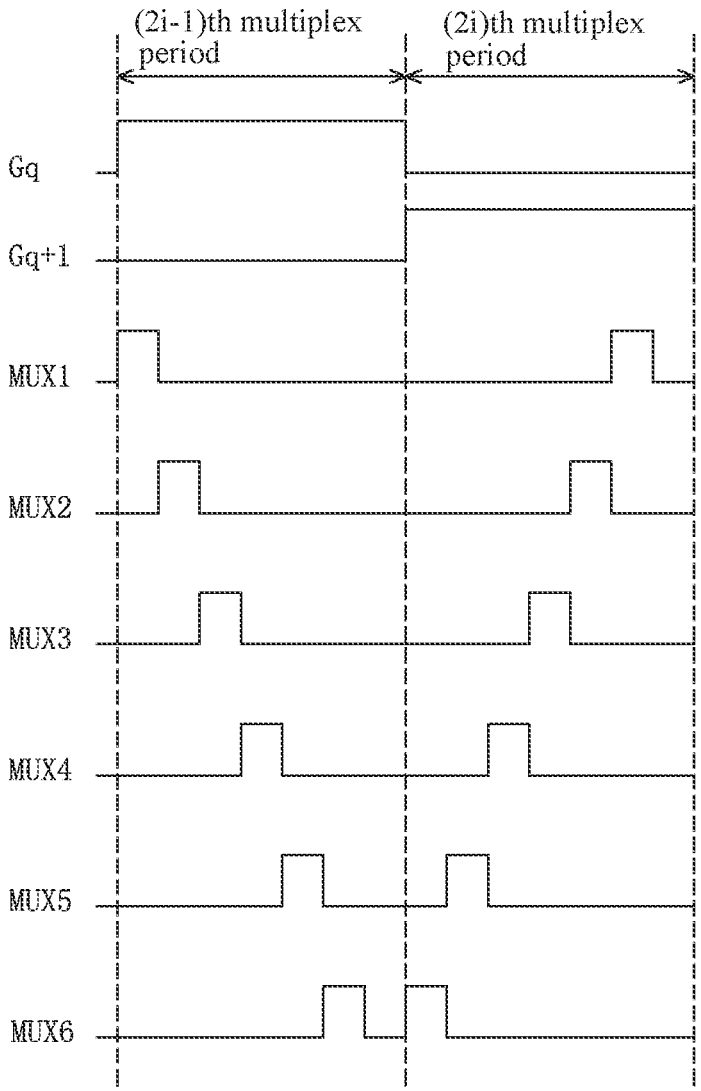
FIG. 6 is a schematic diagram of step S2 and step S3 of a drive method of a display panel according to a first embodiment of the present disclosure.

A description is provided with reference to FIG. 6. According to a first embodiment of the present disclosure, the (2i−1)th multiplex period comprises one first row period. A voltage Gq on a qth scan_line 30 is at a high level, and voltages on the scan lines 30 other than the qth scan line 30 in the plurality of scan lines 30 are all at a low level in the (2i−1)th multiplex period. q is a positive integer. That is, according to the first embodiment of the present disclosure, the 2i−1 multiplex period corresponds to a turn-on timing of a qth row of sub-pixels 11 corresponding to the qth scan line 30.

A duration of the high-level pulse of the first multiplex signal MUX1, the second multiplex signal MUX2, the third multiplex signal MUX3, the fourth multiplex signal MUX4, the fifth multiplex signal MUX5, and the sixth multiplex signal MUX6 is the same.

A description is provided with reference to FIG. 6. In the first embodiment, the first multiplex signal MUX1, the second multiplex signal MUX2, the third multiplex signal MUX3, the fourth multiplex signal MUX4, the fifth multiplex signal MUX5, and the sixth multiplex signal MUX6 sequentially generate the high level pulse in each of the first row periods.

Step S3: A (2i)th multiplex period is entered.

The (2i)th multiplex period comprises p second row periods. The first multiplex signal MUX1, the second multiplex signal MUX2, the third multiplex signal MUX3, the fourth multiplex signal MUX4, the fifth multiplex signal MUX5, and the sixth multiplex signal MUX6 sequentially generate the high level pulse in a reverse order to the predetermined order in each of the second row periods.

A description is provided with reference to FIG. 6. According to the first embodiment of the present disclosure, the (2i)th multiplex period comprises one second row period. A voltage Gq+1 on a_(q+1)th scan line 30 is at the high level, and voltages on the scan lines 30 other than the (q+1)th scan line 30 in the plurality of scan lines 30 are all at the low level in the (2i)th multiplex period. That is, according to the first embodiment of the present disclosure, the 2i multiplex period corresponds to a turn-on timing of a (q+1)th row of sub-pixels 11 corresponding to the qth scan line 30.

A description is provided with reference to FIG. 6. In the first embodiment of the present disclosure, the sixth multiplex signal MUX6, the fifth multiplex signal MUX5, the fourth multiplex signal MUX4, the third multiplex signal MUX3, the second multiplex signal MUX2, and the first multiplex signal MUX1 sequentially generate the high level pulse in each of the second row periods.

Figure 7:
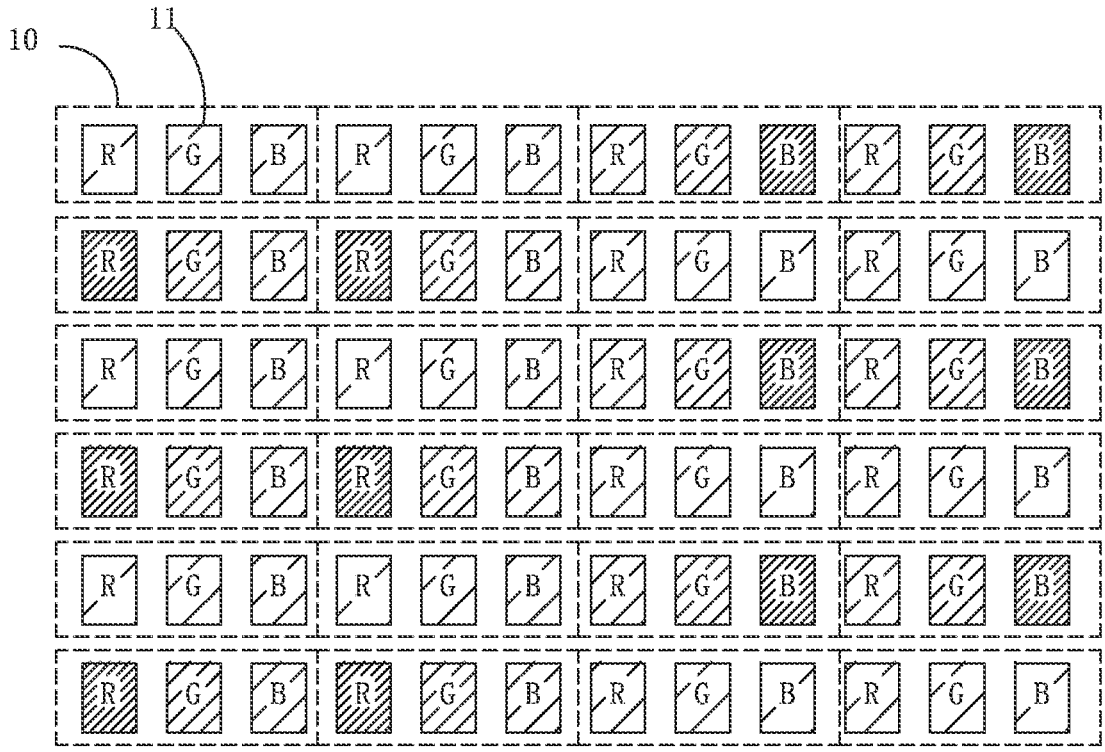
FIG. 7 is a schematic diagram of a display effect of the drive method for the display panel according to the first embodiment of the present disclosure.

In the drive method for the display panel according to the first embodiment of the present disclosure, the first multiplex signal MUX1, the second multiplex signal MUX2, the third multiplex signal MUX3, the fourth multiplex signal MUX4, the fifth multiplex signal MUX5, and the sixth multiplex signal MUX6 sequentially generate the high level pulse in the predetermined order in the (2i−1)th multiplex period, that is, the turn-on timing of the qth row of sub-pixels 11 corresponding to the qth scan line 30. In greater detail, the first multiplex signal MUX1, the second multiplex signal MUX2, the third multiplex signal MUX3, the fourth multiplex signal MUX4, the fifth multiplex signal MUX5, and the sixth multiplex signal MUX6 sequentially generate the high level pulse, so that the red sub-pixels R in the pixels 10 of the first column and the second column, the green sub-pixels G in the pixels 10 of the first column and the second column, the blue sub-pixels B in the pixels 10 of the first column and the second column, the red sub-pixels R in the pixels 10 of the third column and the fourth column, the green sub-pixels G in the pixels 10 of the third column and the fourth column, and the blue sub-pixels B in the pixels 10 of the third column and the fourth column in the qth row of sub-pixels 11 are sequentially charged in the (2i−1)th multiplex period. In addition, in the (2i)th multiplex period, that is, the turn-on timing of the (q+1)th row of sub-pixels 11 corresponding to the (q+1)th scan line 30, the first multiplex signal MUX1, the second multiplex signal MUX2, the third multiplex signal MUX3, the fourth multiplex signal MUX4, the fifth multiplex signal MUX5, and the sixth multiplex signal MUX6 sequentially generate the high level pulse in a reverse order to the predetermined order. In greater detail, the sixth multiplex signal MUX6, the fifth multiplex signal MUX5, the fourth multiplex signal MUX4, the third multiplex signal MUX3, the second multiplex signal MUX2, and the first multiplex signal MUX1 sequentially generate the high level pulse, so that the blue sub-pixels B in the pixels 10 of the third column and the fourth column, the green sub-pixels G in the pixels 10 of the third column and the fourth column, the red sub-pixels R in the pixels 10 of the third column and the fourth column, the blue sub-pixels B in the pixels 10 of the first column and the second column, the green sub-pixels G in the pixels 10 of the first column and the second column, and the red sub-pixels R in the pixels 10 of the first column and the second column in the (q+1)th row of sub-pixels 11 are sequentially charged in the (2i)th multiplex period. Then, a description is provided with reference to FIG. 7. When displaying, in the pixels 10 of the first column and the second column, the red sub-pixels R having a charging order of 1 (first) in their corresponding row period and the red sub-pixels R having a charging order of 6 (sixth) in their corresponding row period are alternately arranged and superimposed on each other, the green sub-pixels G having a charging order of 2 (second) in their corresponding row period and the green sub-pixels G having a charging order of 5 (fifth) in their corresponding row period are alternately arranged and superimposed on each other, and the blue sub-pixels B having a charging order of 3 (third) in their corresponding row period and the blue sub-pixels B having a charging order of 4 (fourth) in their corresponding row period are alternately arranged and superimposed on each other. In the pixels 10 of the third column and the fourth column, the red sub-pixels R having a charging order of 4 (fourth) in their corresponding row period and the red sub-pixels R having a charging order of 3 (third) in their corresponding row period are alternately arranged and superimposed on each other, the green sub-pixels G having a charging order of 5 (fifth) in their corresponding row period and the green sub-pixels G having a charging order of 2 (second) in their corresponding row period are alternately arranged and superimposed on each other, and the blue sub-pixels B having a charging order of 6 (sixth) in their corresponding row period and the blue sub-pixels B having a charging order of 1 (first) in their corresponding row period are alternately arranged and superimposed on each other. As a result, a difference in display effect between the pixels 10 of the first and second columns and the pixels 10 of the third and fourth columns is greatly reduced to eliminate mura within the display picture of the display panel. The display quality is effectively improved.

Figure 8:
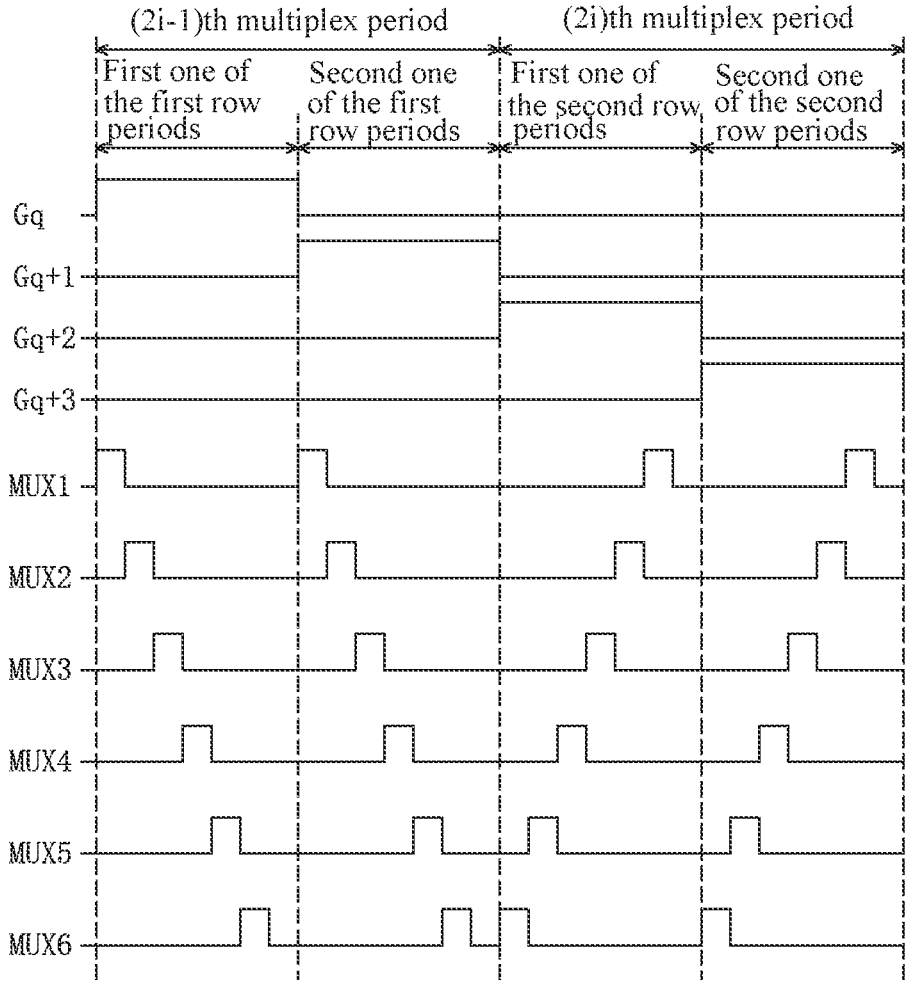
FIG. 8 is a schematic diagram of step S2 and step S3 of a drive method of a display panel according to a second embodiment of the present disclosure.

A description is provided with reference to FIG. 5 and FIG. 8. A drive method of a display panel according to a second embodiment of the present disclosure differs from the first embodiment as follows.

A description is provided with reference to FIG. 8. In step S2, the (2i−1)th multiplex period comprises two first row periods that are sequentially performed. In a first one of the two first row periods of the (2i−1)th multiplex period, a voltage Gq on a qth scan line 30 is at a high level, and voltages on the scan lines 30 other than the qth scan line 30 in the plurality of scan lines 30 are all at a low level. In a second one of the two first row periods of the (2i−1)th multiplex period, a voltage Gq+1 on a (q+1)th scan line 30 is at the high level, and voltages on the scan lines 30 other than the (q+1)th scan line 30 in the plurality of scan lines 30 are all at the low level. That is, according to the second embodiment of the present disclosure, the two first row periods in the (2i−1)th multiplex period are respectively corresponding to a turn-on timing of a qth row of sub-pixels 11 corresponding to the qth scan line 30 and a turn-on timing of a (q+1)th row of sub-pixels 11 corresponding to the (q+1)th scan line 30.

A description is provided with reference to FIG. 8. In step S3, the (2i)th multiplex period comprises two second row periods that are sequentially performed. In a first one of the two second row periods of the (2i)th multiplex period, a voltage Gq+2 on a (q+2)th scan line 30 is at the high level, and voltages on the scan lines 30 other than the (q+2)th scan line 30 in the plurality of scan lines 30 are all at the low level. In a second one of the two second row periods of the (2i)th multiplex period, a voltage Gq+3 on a (q+3)th scan line 30 is at the high level, and voltages on the scan lines 30 other than the (q+3)th scan line 30 in the plurality of scan lines 30 are all at the low level. That is, according to the second embodiment of the present disclosure, the two second row periods in the (2i)th multiplex period are respectively corresponding to a turn-on timing of a (q+2)th row of sub-pixels 11 corresponding to the (q+2)th scan line 30 and a turn-on timing of a (q+3)th row of sub-pixels 11 corresponding to the (q+3)th scan line 30.

Since the rest are the same as the first embodiment, a description in this regard is not provided.

Figure 9:
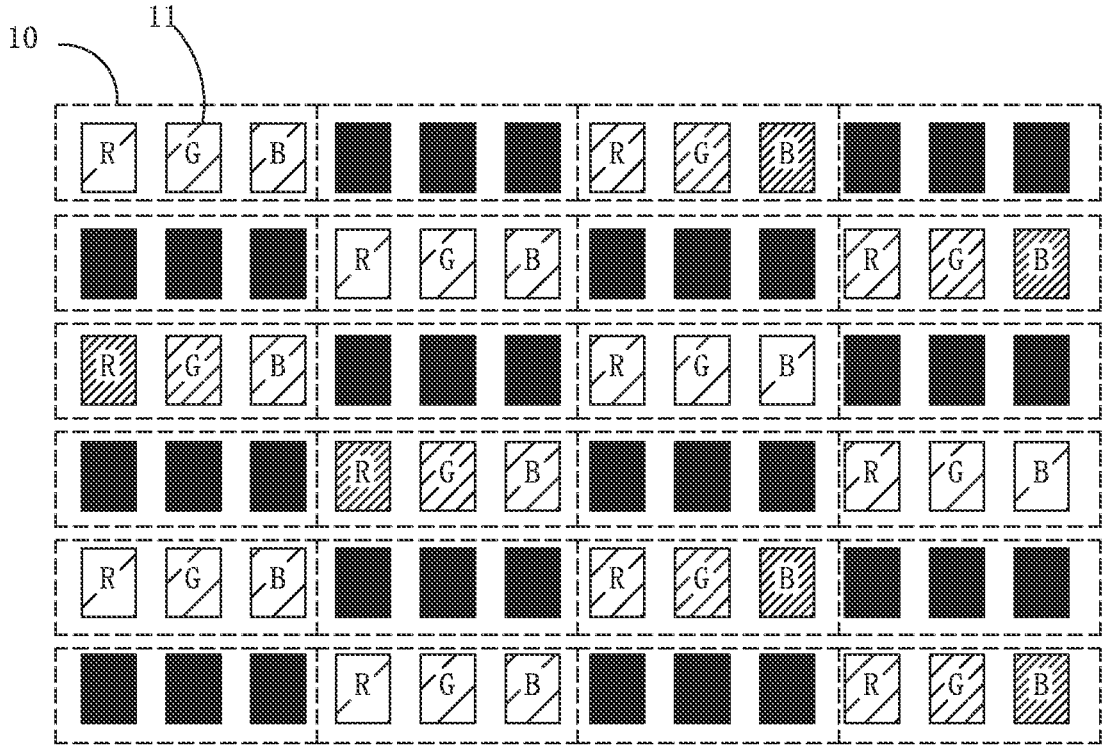
FIG. 9 is a schematic diagram of a display effect of the drive method for the display panel according to the second embodiment of the present disclosure.

A display panel sometimes shows a bright picture and a dark picture alternately, as shown in FIG. 9. Under the circumstances, pixels 10 of odd-numbered rows and odd-numbered columns and pixels 10 of even-numbered rows and even-numbered columns emit light and are in a bright state, whereas pixels 10 of odd-numbered rows and even-numbered columns and pixels 10 of even-numbered rows and odd-numbered columns do not emit light and are in a dark state. At this time, if the drive method of the first embodiment is still adopted, the charging effect of the pixels 10 in the bright state of a same column is the same, but the charging effect of the pixels 10 in the bright state of different columns is different. As a result, the mura problem still occurs. Therefore, in the drive method for the display panel according to the second embodiment of the present disclosure, the first multiplex signal MUX1, the second multiplex signal MUX2, the third multiplex signal MUX3, the fourth multiplex signal MUX4, the fifth multiplex signal MUX5, and the sixth multiplex signal MUX6 sequentially generate the high level pulse in the predetermined order in each of the first row periods of the (2i−1)th multiplex period, that is, the turn-on timing of the qth row of sub-pixels 11 corresponding to the qth scan line 30 and the turn-on timing of the (q+1)th row of sub-pixels 11 corresponding to the (q+1)th scan line 30. In greater detail, the first multiplex signal MUX1, the second multiplex signal MUX2, the third multiplex signal MUX3, the fourth multiplex signal MUX4, the fifth multiplex signal MUX5, and the sixth multiplex signal MUX6 sequentially generate the high level pulse in each of the first row periods. Hence, in the (2i−1)th multiplex period, the red sub-pixels R in the pixels 10 of the first column and the second column, the green sub-pixels G in the pixels 10 of the first column and the second column, the blue sub-pixels B in the pixels 10 of the first column and the second column, the red sub-pixels R in the pixels 10 of the third column and the fourth column, the green sub-pixels G in the pixels 10 of the third column and the fourth column, and the blue sub-pixels B in the pixels 10 of the third column and the fourth column in the qth row of sub-pixels 11 are sequentially charged, and the red sub-pixels R in the pixels 10 of the first column and the second column, the green sub-pixels G in the pixels 10 of the first column and the second column, the blue sub-pixels B in the pixels 10 of the first column and the second column, the red sub-pixels R in the pixels 10 of the third column and the fourth column, the green sub-pixels G in the pixels 10 of the third column and the fourth column, and the blue sub-pixels B in the pixels 10 of the third column and the fourth column in the (q+1)th row of sub-pixels 11 are sequentially charged. In addition, the first multiplex signal MUX1, the second multiplex signal MUX2, the third multiplex signal MUX3, the fourth multiplex signal MUX4, the fifth multiplex signal MUX5, and the sixth multiplex signal MUX6 sequentially generate the high level pulse in a reverse order to the predetermined order in each of the second row periods of the (2i)th multiplex period, that is, the turn-on timing of the (q+2)th row of sub-pixels 11 corresponding to the (q+2)th scan line 30 and the turn-on timing of the (q+3)th row of sub-pixels 11 corresponding to the (q+3)th scan line 30. In greater detail, the sixth multiplex signal MUX6, the fifth multiplex signal MUX5, the fourth multiplex signal MUX4, the third multiplex signal MUX3, the second multiplex signal MUX2, and the first multiplex signal MUX1 sequentially generate the high level pulse in each of the second row periods. Hence, in the (2i)th multiplex period, the blue sub-pixels B in the pixels 10 of the third column and the fourth column, the green sub-pixels G in the pixels 10 of the third column and the fourth column, the red sub-pixels R in the pixels 10 of the third column and the fourth column, the blue sub-pixels B in the pixels 10 of the first column and the second column, the green sub-pixels G in the pixels 10 of the first column and the second column, and the red sub-pixels R in the pixels 10 of the first column and the second column in the (q+2)th row of sub-pixels 11 are sequentially charged, and the blue sub-pixels B in the pixels 10 of the third column and the fourth column, the green sub-pixels G in the pixels 10 of the third column and the fourth column, the red sub-pixels R in the pixels 10 of the third column and the fourth column, the blue sub-pixels B in the pixels 10 of the first column and the second column, the green sub-pixels G in the pixels 10 of the first column and the second column, and the red sub-pixels R in the pixels 10 of the first column and the second column in the (q+3)th row of sub-pixels 11 are sequentially charged. Then, a description is provided with reference to FIG. 9. When a bright picture and a dark picture are alternately displayed, in the pixels 10 of the first column and the second column, the bright red sub-pixels R having a charging order of 1 (first) in their corresponding row period and the bright red sub-pixels R having a charging order of 6 (sixth) in their corresponding row period are alternately arranged and superimposed on each other, the bright green sub-pixels G having a charging order of 2 (second) in their corresponding row period and the bright green sub-pixels G having a charging order of 5 (fifth) in their corresponding row period are alternately arranged and superimposed on each other, and the bright blue sub-pixels B having a charging order of 3 (third) in their corresponding row period and the bright blue sub-pixels B having a charging order of 4 (fourth) in their corresponding row period are alternately arranged and superimposed on each other. In the pixels 10 of the third column and the fourth column, the bright red sub-pixels R having a charging order of 4 (fourth) in their corresponding row period and the bright red sub-pixels R having a charging order of 3 (third) in their corresponding row period are alternately arranged and superimposed on each other, the bright green sub-pixels G having a charging order of 5 (fifth) in their corresponding row period and the bright green sub-pixels G having a charging order of 2 (second) in their corresponding row period are alternately arranged and superimposed on each other, and the bright blue sub-pixels B having a charging order of 6 (sixth) in their corresponding row period and the bright blue sub-pixels B having a charging order of 1 (first) in their corresponding row period are alternately arranged and superimposed on each other. As a result, a difference in display effect between the pixels 10 of the first and second columns and the pixels 10 of the third and fourth columns is greatly reduced when a bright picture and a dark picture are alternately displayed to eliminate mura within the display picture of the display panel. The display quality is effectively improved.

Additionally, according to other embodiments of the present disclosure, p may be selected as a positive integer greater than 2 depending on practical situations, and which does not affect the implementation of the present disclosure.

In sum, according to the drive method for the display panel of the present disclosure, the first multiplex signal, the second multiplex signal, the third multiplex signal, the fourth multiplex signal, the fifth multiplex signal, and the sixth multiplex signal sequentially generate the high level pulse in the predetermined order in each of the first row periods of the (2i−1)th multiplex period. In addition, the first multiplex signal, the second multiplex signal, the third multiplex signal, the fourth multiplex signal, the fifth multiplex signal, and the sixth multiplex signal sequentially generate the high level pulse in a reverse order to the predetermined order in each of the second row periods of the (2i)th multiplex period. As a result, mura within the display picture of the display panel is eliminated to improve the display quality.

The present disclosure is described in detail in accordance with the above contents with the specific preferred examples. However, this present disclosure is not limited to the specific examples. For the ordinary technical personnel of the technical field of the present disclosure, on the premise of keeping the conception of the present disclosure, the technical personnel can also make simple deductions or replacements, and all of which should be considered to belong to the protection scope of the present disclosure.

What is claimed is:

1. A drive method for a display panel comprising: providing a display panel; the display panel comprising a plurality of driving units, each of the driving units comprising a plurality of pixels arranged in a plurality of rows and four columns, twelve data lines and a multiplexing module, each of the pixels comprising three sub-pixels arranged in one row, the three sub-pixels being sequentially a red sub-pixel, a green sub-pixel, and a blue sub-pixel, the sub-pixels of the plurality of pixels being arranged in a plurality of rows and twelve columns, the sub-pixels of a same column having a same color, one data line being connected to one column of sub-pixels correspondingly, the multiplexing module comprising twelve switching elements respectively corresponding to the twelve columns of sub-pixels, output terminals of the twelve switching elements being respectively connected to the twelve data lines connected to the twelve columns of sub-pixels, input terminals of the switching elements corresponding to the sub-pixels of odd columns being all connected to an nth data signal, wherein n is a positive integer, input terminals of the switching elements corresponding to the sub-pixels of even columns being all connected to an (n+1)th data signal, control terminals of the switching elements corresponding to the red sub-pixels in the pixels of a first column and a second column being connected to a first multiplex signal, control terminals of the switching elements corresponding to the green sub-pixels in the pixels of the first column and the second column being connected to a second multiplex signal, control terminals of the switching elements corresponding to the blue sub-pixels in the pixels of the first column and the second column being connected to a third multiplex signal, control terminals of the switching elements corresponding to the red sub-pixels in the pixels of a third column and a fourth column being connected to a fourth multiplex signal, control terminals of the switching elements corresponding to the green sub-pixels in the pixels of the third column and the fourth column being connected to a fifth multiplex signal, control terminals of the switching elements corresponding to the blue sub-pixels in the pixels of the third column and the fourth column being connected to a sixth multiplex signal;

entering a (2i−1)th multiplex period; the (2i−1)th multiplex period comprising p first row periods, the first multiplex signal, the second multiplex signal, the third multiplex signal, the fourth multiplex signal, the fifth multiplex signal, and the sixth multiplex signal sequentially generating a high level pulse in each of the first row periods in a predetermined order, wherein i and p are both positive integers;

entering a (2i)th multiplex period; the (2i)th multiplex period comprising p second row periods, the first multiplex signal, the second multiplex signal, the third multiplex signal, the fourth multiplex signal, the fifth multiplex signal, and the sixth multiplex signal sequentially generating the high level pulse in a reverse order to the predetermined order in each of the second row periods.

2. The drive method for the display panel as claimed in claim 1, wherein each of the driving units further comprises a plurality of scan lines, one scan line is connected to one row of sub-pixels correspondingly.

3. The drive method for the display panel as claimed in claim 2, wherein the (2i−1)th multiplex period comprises one first row period, the (2i)th multiplex period comprises one second row period.

4. The drive method for the display panel as claimed in claim 3, wherein a voltage on a qth scan line is at a high level, and voltages on the scan lines other than the qth scan line in the plurality of scan lines are all at a low level in the (2i−1)th multiplex period, wherein q is a positive integer;

a voltage on a (q+1)th scan line is at the high level, and voltages on the scan lines other than the (q+1)th scan line in the plurality of scan lines are all at the low level in the (2i)th multiplex period.

5. The drive method for the display panel as claimed in claim 2, wherein the (2i−1)th multiplex period comprises two first row periods that are sequentially performed, the (2i)th multiplex period comprises two second row periods that are sequentially performed.

6. The drive method for the display panel as claimed in claim 5, wherein in a first one of the two first row periods of the (2i−1)th multiplex period, a voltage on a qth scan line is at a high level, and voltages on the scan lines other than the qth scan line in the plurality of scan lines are all at a low level, wherein q is a positive integer, in a second one of the two first row periods of the (2i−1)th multiplex period, a voltage on a (q+1)th scan line is at the high level, and voltages on the scan lines other than the (q+1)th scan line in the plurality of scan lines are all at the low level;

in a first one of the two second row periods of the (2i)th multiplex period, a voltage on a (q+2)th scan line is at a high level, and voltages on the scan lines other than the (q+2)th scan line in the plurality of scan lines are all at a low level, in a second one of the two second row periods of the (2i)th multiplex period, a voltage on a (q+3)th scan line is at the high level, and voltages on the scan lines other than the (q+3)th scan line in the plurality of scan lines are all at the low level.

7. The drive method for the display panel as claimed in claim 1, wherein the first multiplex signal, the second multiplex signal, the third multiplex signal, the fourth multiplex signal, the fifth multiplex signal, and the sixth multiplex signal sequentially generate a high level pulse every first row period; the sixth multiplex signal, the fifth multiplex signal, the fourth multiplex signal, the third multiplex signal, the second multiplex signal, and the first multiplex signal sequentially generate a high level pulse every second row period.

8. The drive method for the display panel as claimed in claim 1, wherein the display panel is a liquid crystal display (LCD) panel or an organic light emitting diode (OLED) panel.

9. The drive method for the display panel as claimed in claim 1, wherein a duration of the high-level pulse of the first multiplex signal, the second multiplex signal, the third multiplex signal, the fourth multiplex signal, the fifth multiplex signal, and the sixth multiplex signal is the same.

10. The drive method for the display panel as claimed in claim 1, wherein the switching elements are thin film transistors; the control terminals of the switching elements are gates of the thin film transistors, the input terminals of the switching elements are sources of the thin film transistors, and the output terminals of the switching elements are drains of the thin film transistors.

* * * * *